US005409167A

United States Patent [19]

Borod

[11] Patent Number: 5,409,167

[45] **Date of Patent: * Apr. 25, 1995**

[54] HYGIENIC SPRAY APPARATUS

[76] Inventor: Murray Borod, 3723 Parker Hill Rd., Santa Rosa, Calif. 95404

[ * ] Notice: The portion of the term of this patent subsequent to Aug. 9, 2011 has been disclaimed.

[21] Appl. No.: 230,812

[22] Filed: Apr. 21, 1994

Related U.S. Application Data

[63] Continuation-in-part of Ser. No. 111,117, Aug. 24, 1993, Pat. No. 5,335,855.

[51] Int. Cl.[6] ..... B05B 1/16; B05B 9/043

[52] U.S. Cl. ..... 239/152; 239/332; 239/351; 239/361; 239/391; 239/562; 222/333

[58] Field of Search ..... 239/16, 152, 154, 279, 239/282, 283, 391, 562, 566, 587.1, 588, 332, 333, 351, 355, 361, 373; 222/401, 575, 333; 604/140, 146, 151

[56] References Cited

U.S. PATENT DOCUMENTS

| | | | |
|---|---|---|---|
| 40,192 | 10/1863 | Singer | 239/373 X |
| 528,946 | 11/1894 | Knittel | 239/373 |
| 1,609,125 | 11/1926 | Pitt | 604/146 X |
| 3,602,921 | 9/1971 | Umann et al. . | |
| 3,724,760 | 4/1973 | Smith . | |
| 3,782,814 | 1/1974 | Greenblatt . | |
| 3,808,608 | 5/1974 | Caplan . | |
| 3,901,449 | 8/1975 | Bochmann | 239/332 |
| 3,914,804 | 10/1975 | Schrader et al. . | |
| 3,947,899 | 4/1976 | Robinson et al. . | |
| 4,092,744 | 6/1978 | Butoi . | |
| 4,100,917 | 7/1978 | Talge et al. . | |
| 4,178,931 | 12/1979 | Lind et al. . | |
| 4,222,525 | 9/1980 | Hildebrandt | 239/351 X |
| 4,259,754 | 4/1981 | Bader et al. . | |
| 4,622,704 | 11/1986 | Chung . | |
| 4,651,903 | 3/1987 | Pagliai | 239/332 X |
| 4,801,088 | 1/1989 | Baker | 239/332 X |
| 4,881,687 | 11/1989 | Ballu | 222/401 X |
| 5,046,667 | 9/1991 | Fuhrig | 239/351 X |
| 5,097,540 | 3/1992 | Lovitt . | |
| 5,122,427 | 6/1992 | Flowers et al. . | |

FOREIGN PATENT DOCUMENTS

| | | | |
|---|---|---|---|
| 164621 | 1/1954 | Australia | 239/351 |
| 3546176 | 7/1987 | Germany . | |
| 2133055 | 7/1984 | United Kingdom . | |
| 2233553 | 1/1991 | United Kingdom . | |

*Primary Examiner*—William Grant
*Attorney, Agent, or Firm*—Richard C. Litman

[57] ABSTRACT

A hygienic spray bottle dispenses liquid through a discharge tube. The spray bottle includes an electrically powered pump for pressurizing the liquid; a discharge tube having a nozzle; a valve for dispensing the pressurized liquid; and a pickup tube extending to the bottom of the bottle. A rechargeable battery powers the pump. The discharge tube is configured to cooperate with a toilet bowl wall to allow the spray bottle to function as a portable bidet. The discharge tube has a sliding sleeve for selectively covering and uncovering liquid spray holes to vary the spray pattern or location. Alternatively, the discharge tube includes a flexible section to vary the orientation of the nozzle for douching. The hygienic spray bottle is capable of being used in the absence of an external plumbing system.

7 Claims, 6 Drawing Sheets

54
56
58
60
60
62
64
64
66
66

HYGIENIC SPRAY APPARATUS

This is a continuation-in-part of pending application Ser. No. 08/111,117, filed Aug. 24, 1993 entitled "Hygienic Spray Bottle, now U.S. Pat. No. 5,335,855."

BACKGROUND OF THE INVENTION

1. Field of the infention

The present invention relates to a spray bottle for dispensing a spray upon demand.

2. Description of the Prior Art

There exists a need for a portable hygienic device for rectal or vaginal douching, or other cleaning by spray. Most known bidets are self-contained units, which are large and heavy, and are not of a portable nature. To meet this need, and to take advantage of preexisting toilets or water closets, bidet accessories have been developed for attachment to preexisting toilets or plumbing systems. Certain devices, both of the bidet type and for other purposes, are capable of holding liquid and dispensing the same under pressure.

U.S. Pat. No. 1,609,125, issued to M. Waldron Pitt on Nov. 30, 1926, discloses a fountain spray having a reservoir of liquid and a hand pump for building up the pressure within the reservoir. The pressurized liquid is dispensed from the reservoir to an applicator when a valve is opened. The reservoir includes indicia marking the level of the remaining liquid.

U.S. Pat. No. 3,602,921, issued to Harry M. Umann et al. on Sep. 7, 1971, discloses a portable bidet having a reservoir for holding a douching liquid and a hand pump for dispensing liquid. The pump expels that amount of liquid contained therein.

U.S. Pat. No. 3,808,608, issued to David Caplan on May 7, 1974, discloses a portable bidet which has a powered water pump, and which sits on an adjacent environmental surface. The liquid discharge nozzle is attach to the toilet.

U.S. Pat. No. 3,914,804, issued to Clarence O. Schrader et al. on Oct. 28, 1975, discloses a bidet accessory mountable on a toilet bowl, and features electrically powered water pressurization and heating. Different functions, such as for douching or for an enema, can be accommodated by changing water discharge tubes which support a nozzle.

U.S. Pat. No. 4,178,931, issued to Gene C. Lind on Dec. 18, 1979, discloses a portable bidet with an electrically driven pump. Lind has a thin walled housing assembly including two rectangular halves arranged in a telescoping fashion.

U.S. Pat. No. 4,259,754, issued to Jacob Bader et al. on Apr. 7, 1981, disclosing a bidet accessory having a liquid reservoir. A spring biased piston bears on the reservoir, thereby pressurizing the liquid. The reservoir is filled by attachment to a plumbing system with sufficient pressure to fill the reservoir while pushing the piston back against the force of the spring. A manually operated valve releases liquid for spraying.

U.S. Pat. No. 5,097,540, issued to Harold B. Lovitt on Mar. 24, 1992, describes a self-contained, hand-held bidet which may be pressurized by a hand pump.

Great Britain Patent Application No. 2,133,055 A for Albert McInally published Jul. 18, 1984; Great Britain Patent Application No. 2,233,553 A for Douglass G. McCandish published Jan. 16, 1991; and German Patent Application 3546,176 A1 for Josef Nemecek published on Jul. 2, 1987, all describe bidet devices of varying construction.

Several patents disclose electric heaters for heating the water before washing. U.S. Pat. No. 3,947,899, issued to Joseph D. Robinson et al. on Apr. 6, 1976, discloses a warm water supply kit with a pressure regulating valve. The device employs electric heating elements and a pneumatic control switch. U.S. Pat. No. 4,092,744, issued to Aristotel Butoi on Jun. 6, 1978, discloses an apparatus mountable on a toilet for washing a person's private parts. U.S. Pat. No. 4,622,704, issued to Jing-Yau Chung on Nov. 18, 1986, discloses a portable sanitary device with an electric heating element.

Separate rechargeable battery packs for powering a variety of electric devices are known. For example, U.S. Pat. Nos. 3,782,814 and 5,122,427, issued to Louis W. Greenblatt and Dale M. Flowers et al., respectively, both disclose rechargeable battery packs.

None of the above patent references, taken either singly or in combination, is seen to describe the instant invention as claimed.

SUMMARY OF THE INVENTION

The present invention operates independently of external plumbing in a practical manner to those far from such amenities, such as would be encountered in camping in wilderness areas. It is also desired to provide as uncomplicated an apparatus as possible, to minimize costs and ensure long term reliability, and, for the benefit of travelers, to make the apparatus small and light weight.

The present portable hygienic device comprises a liquid container and a cap which is screwed thereonto. The container holds liquid for dispensing. The cap includes an electrically driven pump for building up pressure, and a dispensing valve. The hygienic device can be carried about, and the liquid dispensed at will by the driving action of the pump.

A dispensing conduit attaches to the cap, and terminates in a nozzle having a series of holes which determine a desired spray pattern. A sliding sleeve selectively covers and uncovers certain spray holes, so that the spray issues from holes nearer to or farther from the container, as desired. In alternative embodiments, the dispensing conduit is rigid or partially flexible.

The spray apparatus of the novel hygienic device is preferably made part of a kit. The kit also includes small, refillable bottles of therapeutic liquids, which may include, selectively, general tonics, such as those containing aloe; specialized medicaments, as for treatment of hemorrhoids or vaginal douches; and a general cleanser, such as liquid soap suitable for skin contact. The kit also preferably contains a supply of absorbent materials for drying, such as cotton swabs.

Accordingly, it is a principal object of the invention to provide a hygienic spray apparatus.

It is another object of the invention to provide a hygienic spray apparatus which releases pressurized liquid on demand.

It is a further object of the invention to provide a hygienic spray apparatus which has a transparent container having indicia thereon, whereby the amount of liquid being stored is discerned by observation.

Still another object of the invention is to provide a hygienic spray apparatus having a cap which is readily and securely installed and removed by hand.

Yet a further object of the invention is to provide a hygienic spray apparatus which is configured in a manner making it convenient to handle while spraying the rectal or vaginal area.

An additional object of the invention is to provide a hygienic spray apparatus which is configured to cooperate with a toilet bowl.

Yet another object of the invention is to provide a hygienic spray apparatus having a dispensing conduit which selectively varies the spray pattern.

It is an object of the invention to provide improved elements and arrangements in an apparatus for the purposes described that is inexpensive and dependable.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
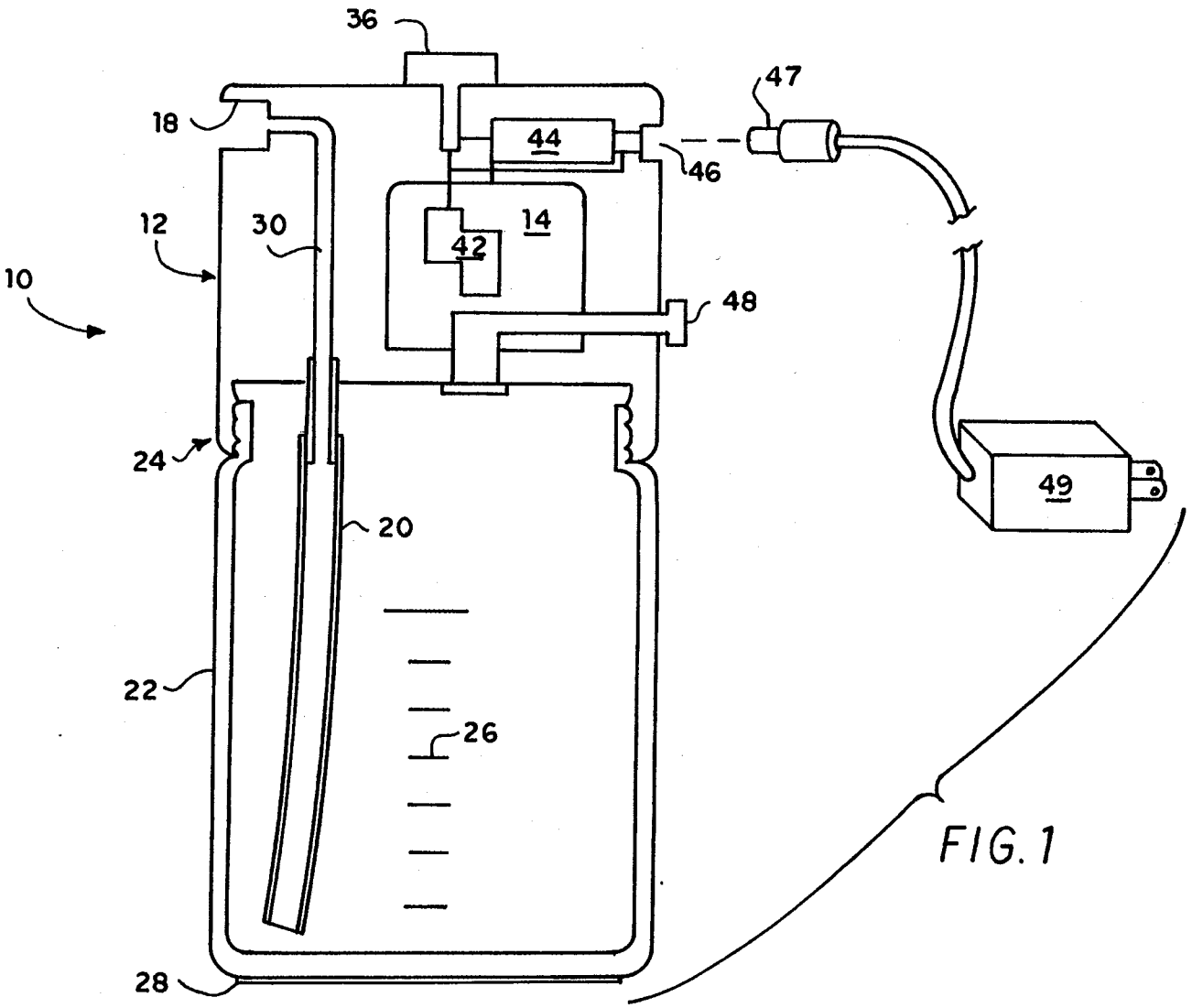
FIG. 1 is a side elevational, cross sectional, diagrammatic view of the spray apparatus in accordance with the instant invention.

Turning first to FIG. 1, the hygienic spray apparatus of the present invention includes a spray bottle 10 which dispenses a stream of liquid on demand. A cap 12 houses a pump 14, a discharge port 18, and a pickup tube 20 which extends to the bottom of storage container 22. Cap 12 attaches to storage container 22 by friction, and preferably by mutual threading 24.

Storage container 22 is preferably made from a transparent or translucent material. Indicia 26 for measuring and for indicating a maximum preferred liquid filling level is included on storage container 22. A resilient member 28 is provided to cushion the bottom of storage container 22 and to improve frictional grip thereof on a supporting environmental surface.

Pump 14 may be any known suitable pump. One suitable pump is a forced air pump 14. Switch 36 activates motor 42 of pump 14. Motor 42 forces surrounding air into storage container 22 through air inlet 48 on the side of cap 12. Air enters storage container 22 through air inlet 48. Air inlet 48 is preferably a spring-biased, one-way check valve. The incoming air pressurizes the liquid in the storage container 22. The pressurized liquid is constrained to flow up through pickup tube 20, through a conduit 30 formed in cap 12, then exiting through port 18, which is open to the atmosphere. Depressing switch 36 again deactivates motor 42 of pump 14. Another suitable pump is a forced liquid pump in which the pump draws liquid from the storage container by suction force. The forced liquid pump will be discussed further in connection with FIG. 9. The suction force may be provided for forced liquid pump by any known method.

Pump 14 is preferably powered by rechargeable batteries 44. While any type of battery is suitable, rechargeable batteries, such as NiCad batteries, allow the user the opportunity to use a low voltage charger 49 to recharge from an electrical outlet. Female plug 46 on cap 12 can accept the male end 47 of low voltage charger 49. While male end 47 is mated with female plug 46, pump 14 is preferably disconnected from batteries 44. The pump is thereby precluded from operating while batteries 44 are being recharged. Pump 14 and batteries 44 are properly isolated to prevent contact with any liquid that may cause a short circuit.

Figures 2, 3:
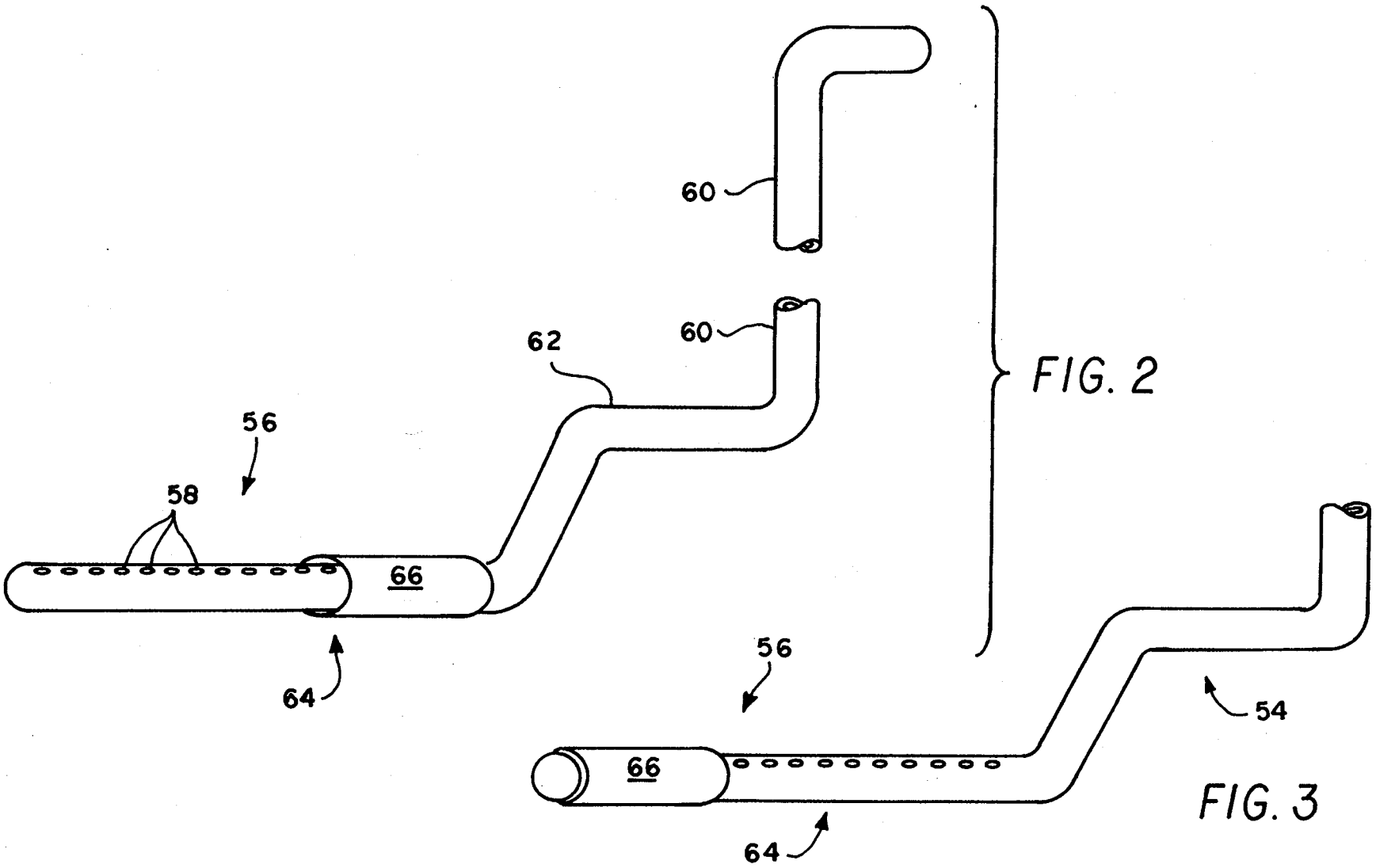
FIGS. 2 and 3 are perspective detail views of a discharge tube, with a sliding sleeve shown in alternative positions on the tube in accordance with the instant invention.

Liquid flows out of cap 12 into a rigid discharge tube 54, seen in FIG. 2. Discharge tube 54 is insertable into port 18, and is retained therein by friction. Discharge tube 54 is preferably formed to include a horizontally arranged connecting section 61 to cooperate with port 18. Liquid in discharge tube 54 is ultimately discharged from nozzle 56 having a plurality of upwardly oriented discharge holes 58.

Figure 6:
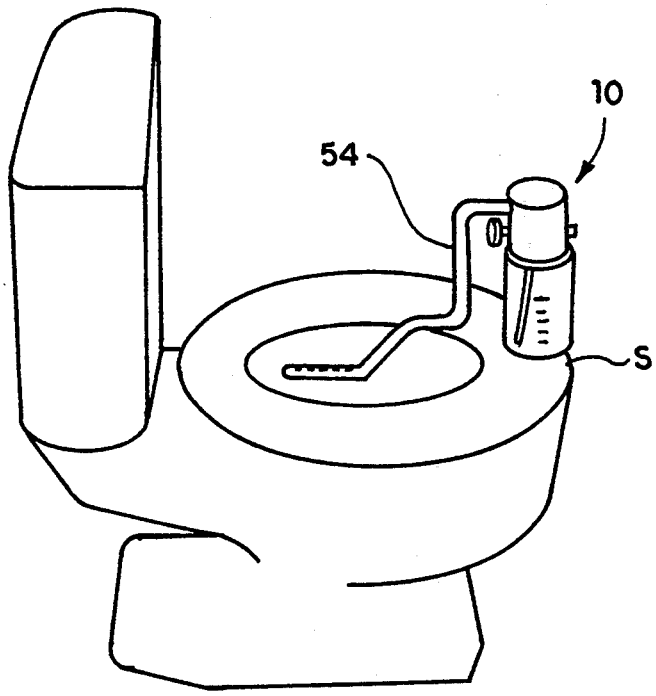
FIG. 6 is an environmental, diagrammatic, perspective detail view of the spray apparatus in accordance with the instant invention.
Figure 7:
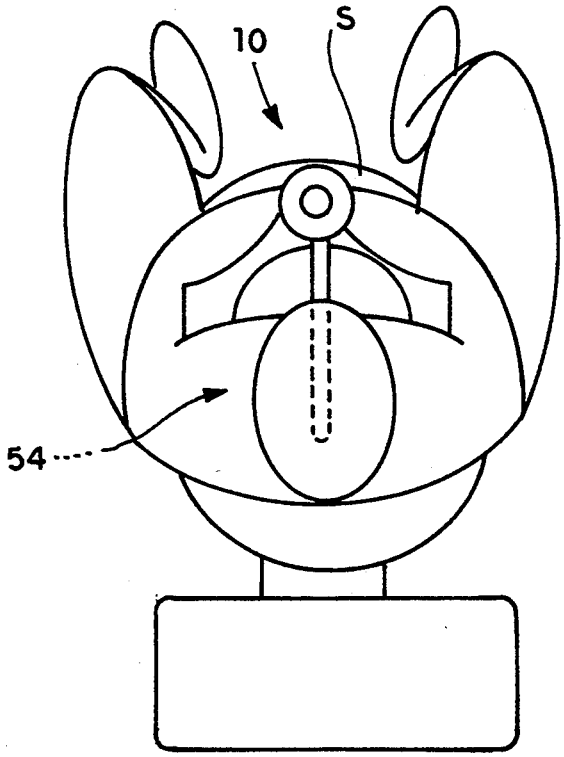
FIG. 7 is an environmental, top plan, diagrammatic view of the spray apparatus in accordance with the instant invention.

The present spray bottle 10 is preferably configured to cooperate with a toilet to serve as a portable bidet. With reference to FIGS. 6 and 7, spray bottle 10 is placed on a toilet bowl wall upper surface S or on a portion of a toilet seat S. Discharge tube 54 is formed to have a first section 60 arranged vertically downward, and a second section 62 projecting horizontally, radially away from storage container 22. Second section 62 is preferably substantially even with the bottom of storage container 22.

A third section 64 is disposed at a level lower than that of second section 62, preferably below the level of the top surface of toilet bowl wall S, and continues to project away from storage container 22. In this manner, discharge tube 54 clears toilet bowl wall or toilet seat S, while still reaching sufficiently far from spray bottle 10 such that spray from nozzle 56 will reach those body parts being treated.

In order to provide adjustment to reach of the spray, a sleeve 66 is slidably mounted on nozzle 56. By moving sleeve 66 appropriately, a user selects certain discharge holes 58 to be operative, others being prevented from discharging liquid.

Figure 4:
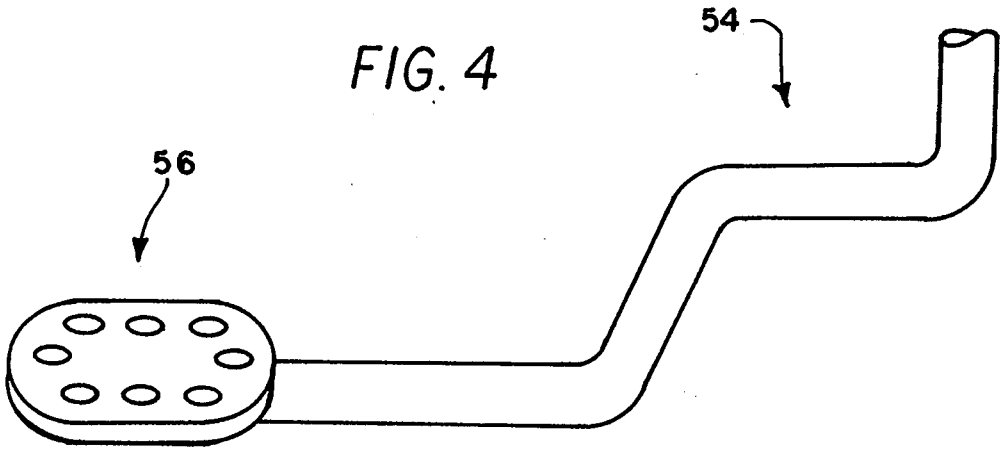

Turning back to FIG. 4, an alternative embodiment discharge tube 54 is shown wherein nozzle 56 is not elongated as in the previous embodiment shown in FIGS. 2 and 3. In addition, no sleeve is required.

Figure 5:
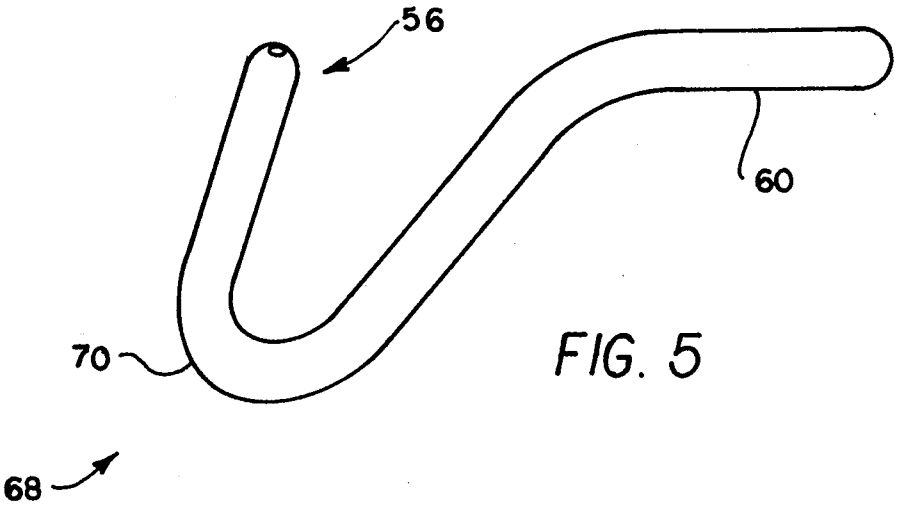
FIGS. 4 and 5 are perspective detail views of alternative embodiment discharge tubes in accordance with the instant invention.

To accommodate those users who must insert a nozzle into the body, as for vaginal douching, another embodiment of a discharge tube is illustrated in FIG. 5. Discharge tube 68 includes a flexible section 70. Nozzle 56 is held selectively at variable orientations by a user even while spray bottle 10 is held at a constant orientation.

Figure 8:
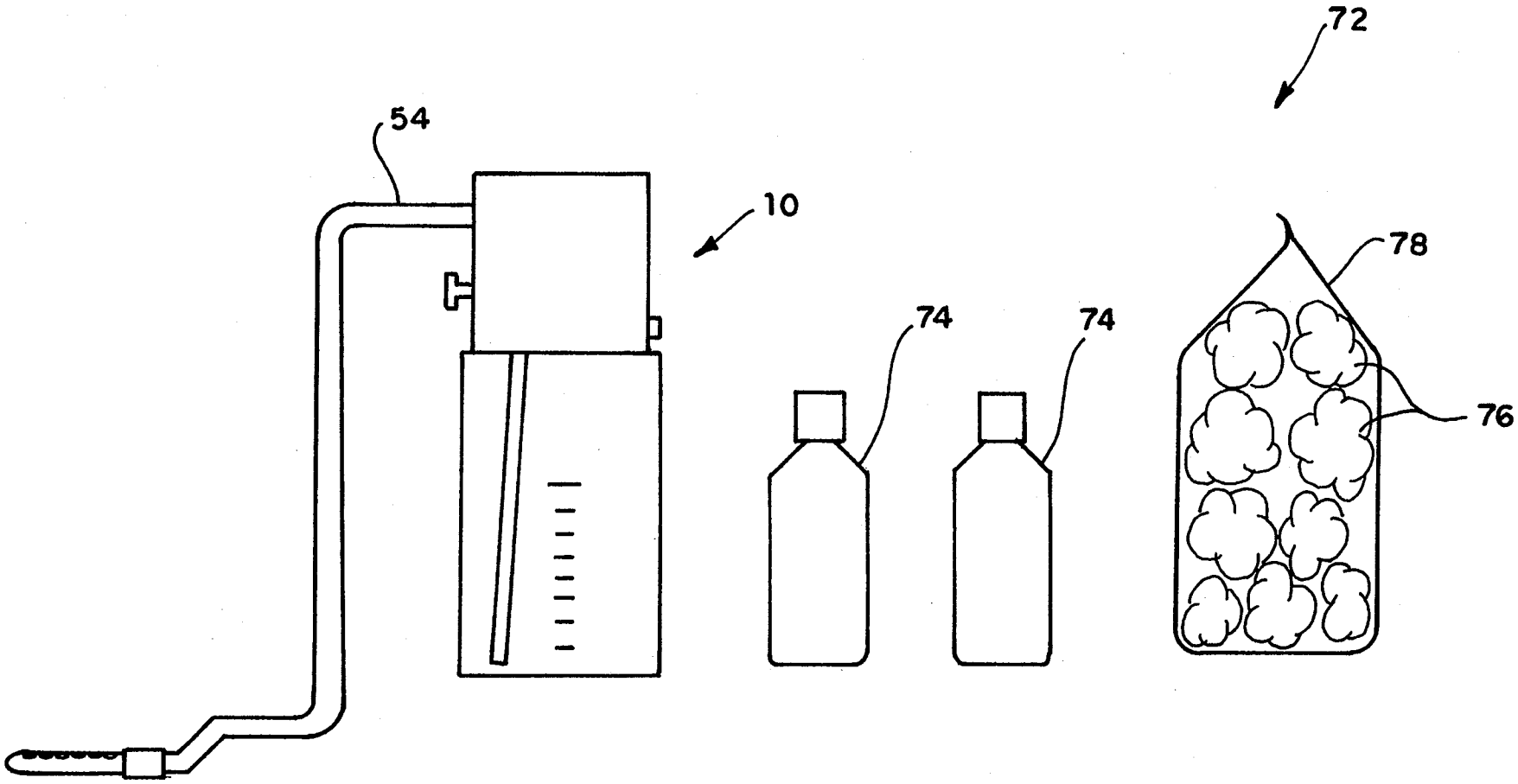
FIG. 8 is a side elevational, diagrammatic view of components of a kit employing the spray apparatus of the instant invention.

Spray bottle 10 and a selected discharge tube may be combined into a hygienic kit 72. As seen in FIG. 8, kit 72 preferably includes at least one refillable bottle 74 containing a therapeutic liquid. An absorbent material is provided for cushioning body parts and wiping spillage from spray bottle 10. A preferred absorbent material is cotton swabs 76, contained in an enclosure 78, such as a plastic bag.

Kit 72 provides many sanitary or therapeutic benefits which are frequently foregone when traveling. All necessary materials are included in a compact, light, portable package, and the apparatus is entirely independent of reliance upon plumbing systems.

Figure 9:
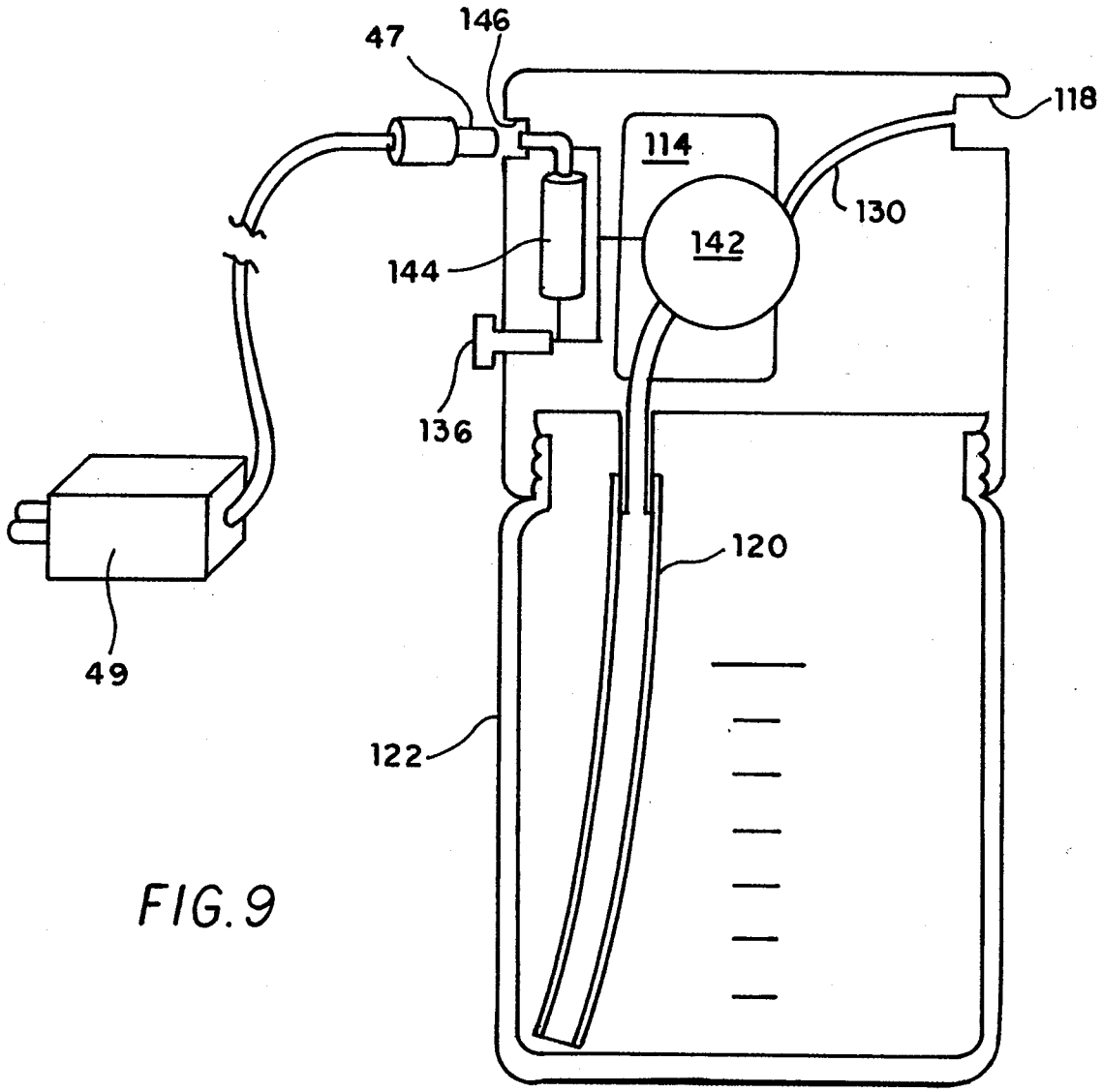
FIG. 9 is a side elevational, cross sectional, diagrammatic view of another embodiment of the spray apparatus in accordance with the instant invention.

FIG. 9 illustrates an alternate embodiment of the instant invention using a forced liquid pump 114. Switch 136 activates motor 142 of pump 114. Being located on the side of cap 112, one can easily activate switch 136 when spray bottle 10 is placed on toilet seat S as shown in FIGS. 6 and 7. Motor 142 creates a suction force for constraining the liquid to flow up through pickup tube 120, and then exit through conduit 130 and port 18, which is open to the atmosphere. Forced liquid pump 114 may create the suction force by any known method.

Pump 114 is preferably powered by rechargeable batteries 44. Female plug 146 can accept the male end 47 of low voltage charger 49. Pump 114 is preferably disconnected from batteries 44 while male end 47 is mated with female plug 46 to preclude operation of pump 114 while batteries 44 are being recharged.

It is to be understood that the present invention is not limited to the embodiments described above, but encompasses any and all embodiments within the scope of the following claims.

I claim:

1. A hygienic spray apparatus comprising:

a storage container for holding liquid;

a cap connecting to said storage container, said cap having a pickup tube projecting downwardly from said cap and extending substantially to the bottom of said storage container, said pick-up tube for conducting the liquid into said cap, a conduit for conducting the liquid through said cap, a port communicating between said conduit and the exterior of said cap, and an electrically powered pump for displacing the liquid in said storage container;

a substantially rigid discharge tube cooperating with said port, and terminating in a nozzle having discharge holes, said discharge tube having a first section extending vertically downwardly and a second section having a distal end projecting horizontally radially away from said storage container at a level substantially even with the bottom of said storage container, wherein said nozzle is at a level below the bottom of said storage container; and a sleeve slidably mounted on said nozzle for covering certain said discharge holes, whereby a user selects which of said discharge holes are operative.

2. The hygienic spray apparatus according to claim 1, wherein said discharge tube further includes a third section connecting said nozzle to said second section and extending away from said storage container at a level lower than the level of said second section.

3. The hygienic spray apparatus according to claim 1, wherein said storage container includes indicia indicating a preferred filling level.

4. A hygienic spray apparatus according to claim 1, further comprising an air inlet, wherein said pump forces air into said container from said air inlet, whereby the liquid is forced out of said storage container through said discharge tube.

5. A hygienic spray apparatus according to claim 1, wherein said pump produces a suction force to draw the liquid out of said storage container through said pick-up tube.

6. A hygienic spray apparatus according to claim 1, further comprising a rechargeable battery for powering said pump.

7. A hygienic spray apparatus according to claim 6, further comprising means for recharging said battery, wherein said recharging means disables said pump while said battery is being recharged.

* * * * *